US009624612B2

(12) United States Patent
Works

(10) Patent No.: US 9,624,612 B2
(45) Date of Patent: Apr. 18, 2017

(54) ALIGN-N-LINE FABRIC ALIGNMENT, MARKING AND CUTTING GUIDE

(71) Applicant: Cornelia G. Works, Eleele, HI (US)

(72) Inventor: Cornelia G. Works, Eleele, HI (US)

( * ) Notice: Subject to any disclaimer, the term of this patent is extended or adjusted under 35 U.S.C. 154(b) by 139 days.

(21) Appl. No.: 14/662,685

(22) Filed: Mar. 19, 2015

(65) Prior Publication Data

US 2015/0267334 A1 Sep. 24, 2015

Related U.S. Application Data

(60) Provisional application No. 61/969,321, filed on Mar. 24, 2014.

(51) Int. Cl.
*D05B 97/12* (2006.01)
*D05B 39/00* (2006.01)

(52) U.S. Cl.
CPC ..... *D05B 97/12* (2013.01); *D05B 39/00* (2013.01)

(58) Field of Classification Search
CPC ..... D05B 39/00; D05B 97/12
USPC ..... 33/494, 562–566; 112/117–119, 258, 112/260, 470.09, 470.11
See application file for complete search history.

(56) References Cited

U.S. PATENT DOCUMENTS 1,338,951 A * 5/1920 Nadel ..... B43L 5/02 33/277
1,733,388 A * 10/1929 Piltzer ..... B42F 7/00 281/16
2,187,574 A * 1/1940 Nigra ..... B43L 5/00 33/430
2,233,481 A * 3/1941 Kuehl ..... B43L 7/0275 33/492
2,355,023 A * 8/1944 Wiren ..... D05B 39/00 112/470.09
3,694,818 A * 10/1972 Nielson ..... A41H 31/00 112/475.09
3,870,000 A * 3/1975 Castany Ferre ..... D05B 3/10 112/475.06
4,053,986 A * 10/1977 Axelrod ..... D04D 7/02 112/475.04
4,349,966 A 9/1982 Marino et al.
4,672,748 A * 6/1987 Perazzolo ..... A41H 3/002 33/11
4,930,382 A * 6/1990 Collins ..... A41H 3/00 33/17 R
D326,279 S * 5/1992 Logan ..... D19/113
5,172,482 A * 12/1992 Coleman ..... B43L 7/04 33/449
D374,404 S 10/1996 Kidd
5,579,670 A 12/1996 McCormick
(Continued)

*Primary Examiner* — R. A. Smith
*Assistant Examiner* — Tania Courson
(74) *Attorney, Agent, or Firm* — Harpman & Harpman

(57) ABSTRACT

A fabric alignment, marking and/or cutting guide that allows for accurate marking, and/or cutting of fabric along the diagonal using a multiple axis fixed edge alignment and a movable triangular angle. The alignment guide has a square cutting board with right angularly positioned upstanding angular edge surfaces for material engagement. A transparent hinged triangular cutting guide plate extends from one alignment edge surface defining a true diagonal line guide edge across a material square to be marked and cut positioned on the cutting board under the triangle guide plate.

7 Claims, 4 Drawing Sheets

(56) References Cited

U.S. PATENT DOCUMENTS

| | | | | | |
|---|---|---|---|---|---|
| 5,653,035 | A * | 8/1997 | Chen | B26B 29/06 | 33/1 K |
| 5,791,062 | A * | 8/1998 | Walker | D05B 97/12 | 33/1 B |
| 5,865,928 | A * | 2/1999 | Lariviere, Jr. | A63F 9/10 | 156/256 |
| 6,276,070 | B1 * | 8/2001 | Hawley | B43L 7/033 | 33/1 G |
| 6,925,724 | B2 | 8/2005 | Tandy | | |
| D519,561 | S * | 4/2006 | Wong | D19/37 | |
| 7,281,337 | B1 * | 10/2007 | Oehlke | D05B 97/12 | 33/566 |
| 7,383,640 | B2 * | 6/2008 | Barry | D05B 11/00 | 33/1 G |
| 7,464,480 | B2 * | 12/2008 | Vetromila | G01B 3/04 | 33/1 G |
| 7,854,073 | B1 * | 12/2010 | Webb | B25H 7/02 | 33/1 G |
| 8,468,709 | B2 * | 6/2013 | Akdeniz | G01B 3/14 | 33/563 |
| 9,138,904 | B2 * | 9/2015 | Thomas | B26B 29/06 | |
| 2006/0192376 | A1 * | 8/2006 | Langford | A45C 3/02 | 281/15.1 |
| 2008/0022542 | A1 * | 1/2008 | Brosmith | B26B 5/00 | 33/562 |
| 2009/0158602 | A1 * | 6/2009 | Lockyer | B43L 7/005 | 33/1 B |

* cited by examiner

ALIGN-N-LINE FABRIC ALIGNMENT, MARKING AND CUTTING GUIDE

This application claims the benefit of U.S. Provisional Application No. 61/969,321, filed Mar. 24, 2014

BACKGROUND OF THE INVENTION

1. Technical Field

This invention relates to fabric marking and cutting devices that are used in sewing, such as quilting to mark and cut specific angular orientation on the fabric.

2. Description of Prior Art

Prior art devices of this type have provided a variety of different cutting guides; see for example U.S. Pat. Nos. 4,349,966, 5,579,670, 6,925,724 and Design Pat. D374,404.

U.S. Pat. No. 4,349,966 is directed to an aligning guide and measuring device having a flat with a raised flange along one edge.

U.S. Pat. No. 5,579,670 discloses a method and system for making quilting pieces having a template and a cutting guide with a rail along one edge thereof.

U.S. Pat. No. 6,925,724 illustrates a square or rectangular quilting ruler with sets of equally spaced rulings running parallel thereto and at right angles so as to be visible when in associated use.

U.S. Pat. No. 7,568,295 claims a quilting tool having a transparent parallelogram plate and guidelines associated thereon.

Finally, in Design Pat. D374,404, a quilting ruler is shown having a rectangular surface with a flange inwardly of one edge.

SUMMARY OF THE INVENTION

A fabric alignment, marking and cutting guide having a self-healing fabric placement surface on which the alignment guide with a top and side raised material engagement edge surfaces are positioned. A hinged transparent triangle guide plate extends from one raised surface for select placement over fabric positioned and aligned on the cutting surface for accurate repetitive diagonal marking and cuts there along.

DETAILED DESCRIPTION OF THE INVENTION

Figure 1:
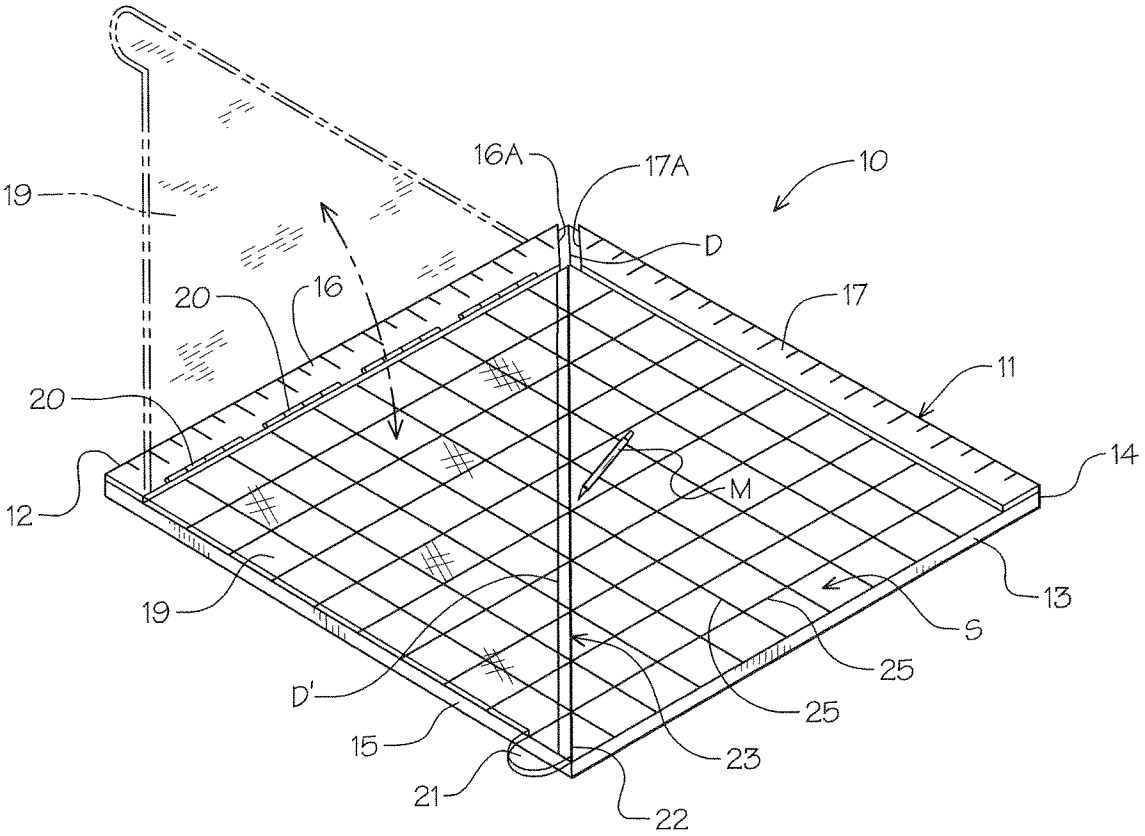
FIG. 1 is a perspective view of the fabric alignment marking and cutting guide of the invention.

Referring to FIG. 1 of the drawings, a fabric alignment marking and cutting guide 10 of the invention can be seen having a support base 11 with spaced oppositely disposed parallel top and bottom edges 12 and 13 and corresponding spaced parallel perimeter side edges 14 and 15 defining a square base configuration. Preferably the base material is of a self-healing configuration so that it can be effectively cut upon without permanent markings affecting future cutting as will be well known and understood by those skilled in the art.

A pair of upstanding perimeter flat guide angles 16 and 17 are positioned at right angles to one another along and extend inwardly from the respective top edge 12 and the side edge 14 of the base 11. The guide angles 16 and 17 have effacing ends 16A and 17A which are in spaced angular orientation to one another forming a cutting gap at 18 therebetween that aligns with the primary diagonal line D illustrated by a line indicia positioned on the base 11 and a secondary parallel line D' for aligning to mark ¼ inch from the edge of fabrics as will be described in greater detail hereinafter.

A right angle triangular transparent guide panel 19 is hinged along one side to the perimeter guide angle 16 by a selective hinge configuration 20. A lifting tab 21 is formed integrally with and extends from a free side edge surface 22 adjacent the panel's defined angular edge cutting surface 23. The hinged configuration 20 may be of any continuous (piano type) or multiple spaced hinged elements so as to assure edge orientation when selectively operated from a first flat base engagement position to an upstanding position as seen in solid and broken lines in FIG. 1 of the drawings.

It will be seen that the cutting guide edge surface 23 of the hinged triangular guide transparent guide panel 19 defines a "true" diagonal across a surface S of the support base 11 and is correspondingly in alignment between the hereinbefore described end gap 18 between the respective guide angles 16 and 17 which will allow for a continuous cutting action therealong as will be described in detail hereinafter.

Figure 2:
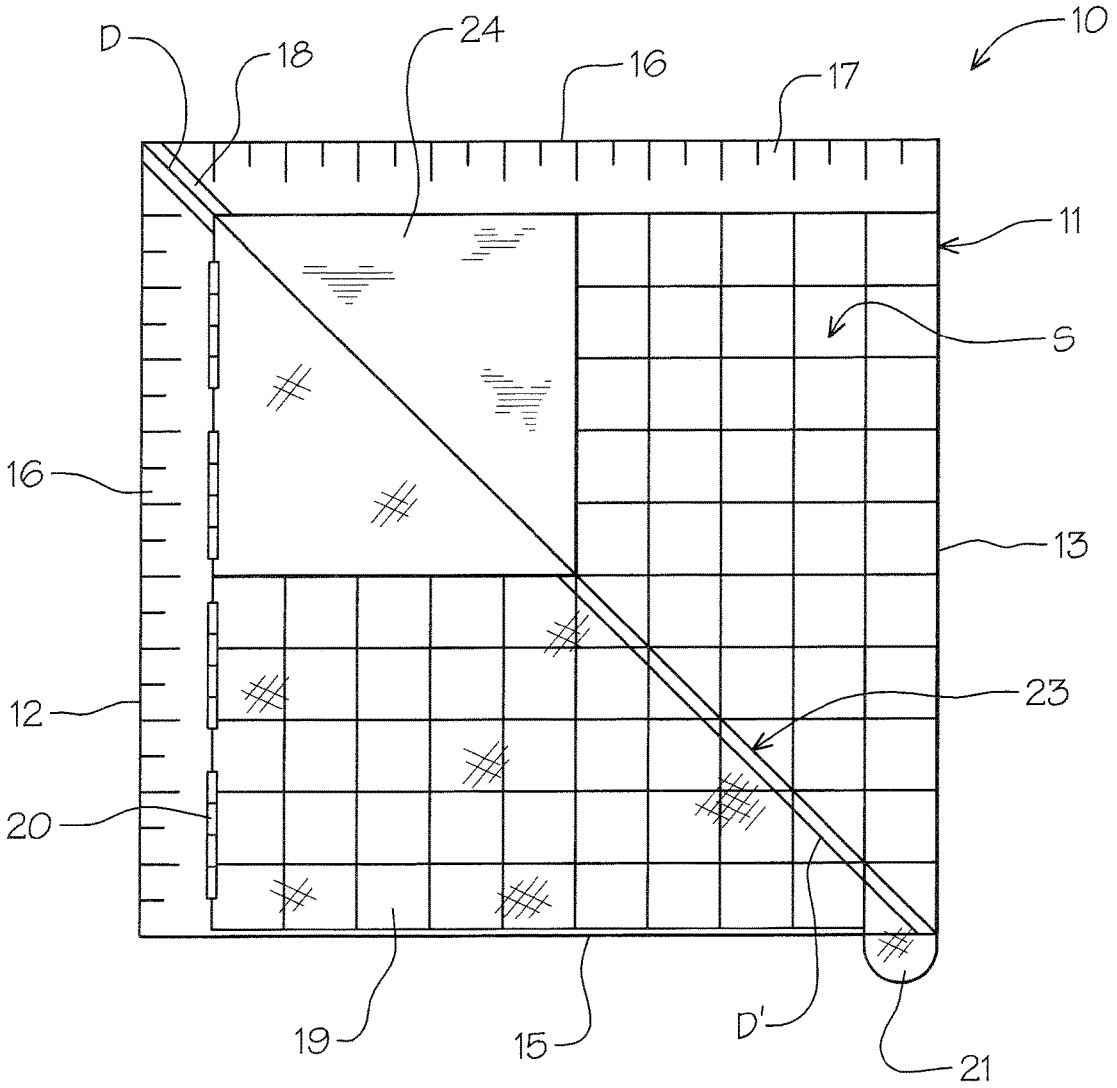
FIG. 2 is a top plan view thereof shown in use by marking for cutting.
Figure 3:
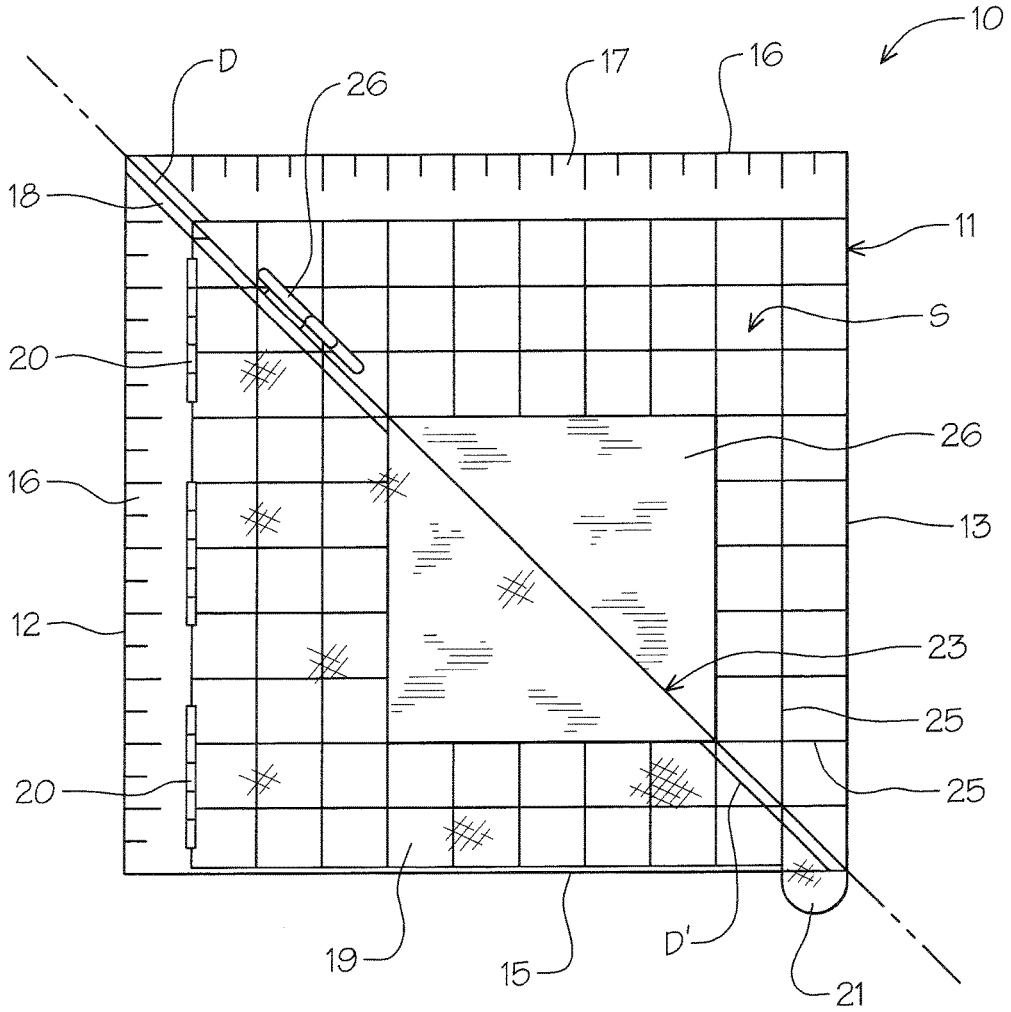
FIG. 3 is a top plan view illustrating alternate material placement on the cutting surface with guide edge engagement for cutting.

In use, the fabric alignment, marking and cutting guide 10, as seen in FIGS. 2 and 3 of the drawings (in this example) a fabric square 24 to be cut is positioned on the support base 11's surface S which is divided into equal portions by a cross gridline pattern 25. The transparent guide panel 19 is raised and the fabric square 24 is placed on the grid line supporting base 11 surface S in abutting relationship to the respective perimeter guide angles 16 and 17. The guide panel 19 is then lowered onto the fabric square 24 holding it firmly in place. It will be seen that this provides a true and accurate diagonal guide there across for marking M or cutting along the guide edge surface 23 of the guide panel 19 which in this example for cutting an illustrative rotary cutter representation 26 is shown graphically in FIG. 3 of the drawings and is well known in the art can pass along against the guide edge surface 23 cutting the fabric panel 24 diagonally and proceed through the angle gap 18 in a single continuous action or conversely begin at the angle gap 18 and pass along the guide edge surface 23 cutting the fabric as noted.

Alternate fabric square placement is possible and can be seen as illustrated in FIG. 3 of the drawings wherein a fabric square 26 is aligned on the base 11 surface S by use of the gridline pattern 25 and a diagonal marking and a cut can be made, again by using the triangular guide panel 19 positioned thereover, as described.

Figure 4:
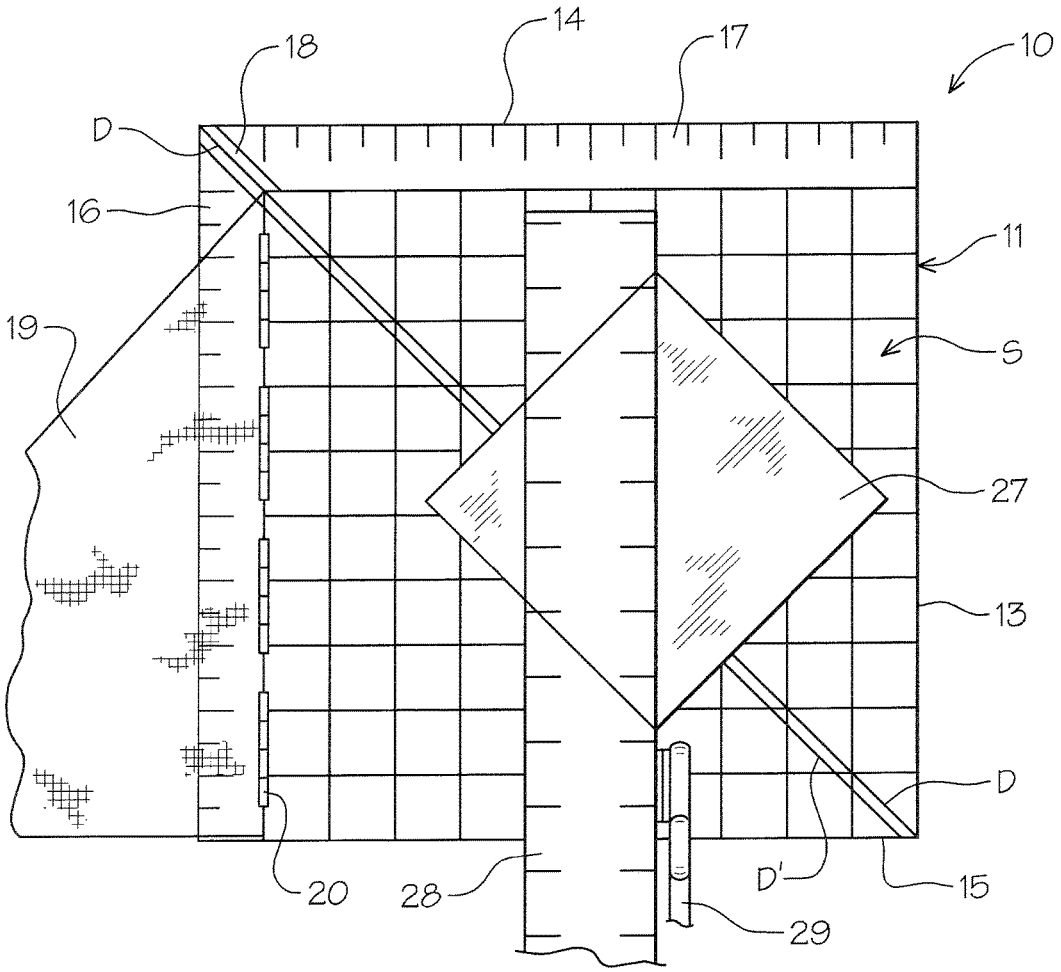
FIG. 4 is a top plan view of an alternate use configuration with an independent straight edge.

It will be evident from the above description that the divided grid line pattern 25 on the base 11 can also be used independently of the guide panel 19 as seen in FIG. 4 of the drawings as follows. A fabric square 27 can therefore be positioned on the base surface S by the alignment with the gridline pattern 25 and independent straight edge 28 may be used to overlie and act as a marking guide via a marker M, in broken lines, and then a cutting edge guide for a rotary cutter representation 29 as illustrated.

The support base 11 in this example, as noted, is preferably made of a self-healing cutting mat surface of a ⅛ inch thickness and divided by the right angular cross gridline pattern 25 in equal incremental increments, such as one-inch in this illustration or other dimensional aspects chosen for alternate applications as would be evident to those skilled in the art. Additionally, a secondary guide line D' can be seen in spaced relation to the primary diagonal line D which would allow for aligning to mark ¼ inch from the edge of fabrics.

It will be seen that incremental indicia measurements are marked along each of the guide angles 16 and 17, in this example at one-inch and ⅛ inch intervals and may be of different colors for easy identification. The transparent movable guide edge panel 19 is preferably made of synthetic resin material with a non-slip bottom surface BS for engagement against the fabric to assure stability thereto while marking or cutting.

It will thus be seen that a new and novel fabric alignment marking and cutting guide of the invention has been illustrated and described and will provide ability to selectively mark diagonal lines on square fabrics fast, easy and accurately. It is evident that the guide is a time saving device when marking the squares and that the straight edge corner liners will assure that the diagonal mark is accurate and the right triangle remains stationary when marking to assure the diagonal mark is also accurate. The cutting base 11 can be used as a cutting surface for rotary cutters, as described, and wherein the right angle panel 19 can be used to guide the rotary blade when cutting diagonal lines as hereinbefore described.

It will thus be evident that various changes and modifications may be made thereto without departing from the spirit of the invention. Therefore I claim:

The invention claimed is:

1. A marking and cutting guide for fabric comprises, a support base having a flat surface with a self-healing mat, a pair of raised perimeter guide bands on said support base, a movable transparent triangular guide cutting and marking panel hinged along one of said guide, bands, movable from a first position on said self-healing mat to a second upstanding position, said guide bands at right angles to one another having equal spaced measuring scales indicia thereon, said guide bands effacing ends in spaced parallel angular orientation to one another defining a cutting gap there between, a first diagonal guide line indicia on said self-healing mat intersecting said cutting gap between said guide bands and a second diagonal guide line indicia in parallel spaced relation thereto.

2. The marking and cutting guide for fabrics set forth in claim 1 wherein a plurality of grid lines are marked on said self-healing mat, said grid lines in substantially alignment with and extending visually from corresponding measuring scales indicia on said guide bands.

3. The marking and cutting guide for fabric set forth in claim 1 wherein said movable transparent triangular guide cutting and marking panel having a diagonal edge aligned on said first diagonal guide line on said self-healing mat when in said first position thereon.

4. The marking and cutting guide for fabric set forth in claim 1 wherein said movable transparent triangle guide cutting and marking panel has a lifting tab extending therefrom in oppositely disposed relation from both of said perimeter guide bands.

5. A method of cutting and marking fabric using a marking and cutting guide, said marking and cutting guide including a square flat support base comprising a self-healing mat, grid lines on said mat, perimeter upstanding right angular disposed guide bands on said support base in spaced facing end to end relationship having measuring scale indicia thereon, a movable transparent triangular guide cutting and marking panel hinged to one of said perimeter guide bands, said method comprising, moving said cutting and marking panel from a first diagonally aligned engaged position on a fabric work piece for cutting and marking diagonally, said fabric work piece positioned on said self-healing mat against said perimeter upstanding right angular guides, positioning a cutting element along a cutting and marking diagonal edge of said cutting guide and marking panel cutting the fabric work piece.

6. The method of claim 5 further comprises, marking the fabric work piece positioned on the self-healing mat diagonally along the cutting and marking edge of said cutting and marking panel engaged on said fabric work piece position thereon.

7. A method of cutting and marking fabric using a marking and cutting guide, the marking and cutting guide including a square flat support base comprising a self-healing mat, grid lines on said mat, perimeter upstanding right angular disposed guide bands on said support base in spaced facing end to end relationship having measuring scale indicia thereon, a transparent triangular guide cutting and marking panel hinged to one of said perimeter right angle disposed guide bands, aligning a square fabric work piece with said grid lines on said self-healing mat in spaced relation to said perimeter upstanding right angular disposed guide bands on said support base, positioning said transparent triangular guide cutting and marking panel on said fabric work piece for cutting and marking therealong.

* * * * *